US005456657A

United States Patent [19]

Cheng

[11] Patent Number: 5,456,657

[45] Date of Patent: Oct. 10, 1995

[54] MASSAGING CHAIR WITH AN ADJUSTABLE BACK SUPPORT

[76] Inventor: Wen-Liang Cheng, No. 22-35, Chi Tzu Tou, Kuan Shih Tsun, Shui Chang Hsiang, Chia I, Taiwan

[21] Appl. No.: 162,768

[22] Filed: Dec. 8, 1993

[51] Int. Cl.[6] ..... A61H 15/00

[52] U.S. Cl. ..... 601/98; 601/99

[58] Field of Search ..... 128/845, 846; 601/51, 52, 89, 91, 92, 97–99, 115–117; D24/211; 606/240–244

[56] References Cited

U.S. PATENT DOCUMENTS

| | | | |
|---|---|---|---|
| 2,895,470 | 7/1959 | Reiter | 601/122 |
| 3,322,116 | 5/1967 | Murphy | 601/52 |
| 3,389,699 | 6/1968 | Mathers | 601/52 |
| 4,193,394 | 3/1980 | Everett | 601/122 |
| 5,056,506 | 10/1991 | Verduci | 601/49 |
| 5,247,925 | 9/1993 | Yamasaki | 601/49 |

*Primary Examiner*—Michael A. Brown

*Attorney, Agent, or Firm*—Beveridge, DeGrandi, Weilacher & Young

[57] ABSTRACT

A massaging chair includes a base frame supported on a wheeled support, a back support pivoted about a pivot on a mounting frame the at bottom of the base frame, a crank lever controlled lock device controlled to lock the back support in any of a series of sloping positions, elastic members connected between the back support and the mounting frame. The elastic members are stretched when the back support is released from the lock device and turned backward. A retractable supporting bar is fastened to the back support by a lock screw, and a back rest on the back support is vertically pivoted to the retractable supporting bar. A plurality of brackets are horizontally pivoted to the back rest at different elevations to hold rotating massaging wheels.

10 Claims, 5 Drawing Sheets

MASSAGING CHAIR WITH AN ADJUSTABLE BACK SUPPORT

BACKGROUND OF THE INVENTION

The present invention relates to a massaging chair which comprises a back support that can be locked in any of a series of sloping positions, and a back rest turned about a pivot on the back support to hold a plurality of rotating massaging wheels for massaging the user's back.

It is known that exercising the body daily and properly can greatly improve the condition of the body. It is also known that massaging the muscles and joints can make them work better. However, most people in cities spend little time in exercising the body. Further, people who work in offices may constantly keep bending the spine while sitting on a chair, thereby causing the spine to ache. One must leave the chair and take a walk or make a movement when the spine aches. Various exercising and massaging apparatuses have been disclosed for exercising or massaging the body in order to keep the body in good condition. However, one cannot use these apparatuses while working.

SUMMARY OF THE INVENTION

The present invention has been accomplished under the aforesaid circumstances. It is therefore an object of the present invention to provide a massaging chair which massages the user's back when the user sits thereon. It is another object of the present invention to provide a massaging chair which can be adjusted to support the back of the user at any of a series of inclined positions.

According to one aspect of the present invention, the massaging chair comprises a base frame having a mounting frame at the bottom, a back support pivoted about a pivot on the mounting frame, a crank lever controlled lock device controlled to lock the back support in any of a series of sloping positions, a retractable supporting bar fastened to the back support by a lock screw, a back rest vertically pivoted to the retractable supporting bar, and a plurality of brackets horizontally pivoted to the back rest at different elevations to hold rotating massaging wheels.

According to another aspect of the present invention, elastic members are connected between the back support and the mounting frame. These elastic members can be stretched when the back support is released from the lock device and turned backwards, and therefore the user can exercise the back.

According to still another aspect of the present invention, a wheeled support is provided to support the base frame so as to make the massaging chair easy to move.

BRIEF DESCRIPTION OF THE DRAWINGS

FIG. 1A shows an embodiment wherein two back rests are combined together;

FIG. 3A shows a massaging wheel mounted on a bracket and turned on its own axis, and the bracket turned horizontally about a pivot;

DETAILED DESCRIPTION OF THE PREFERRED EMBODIMENT

Figure 1:
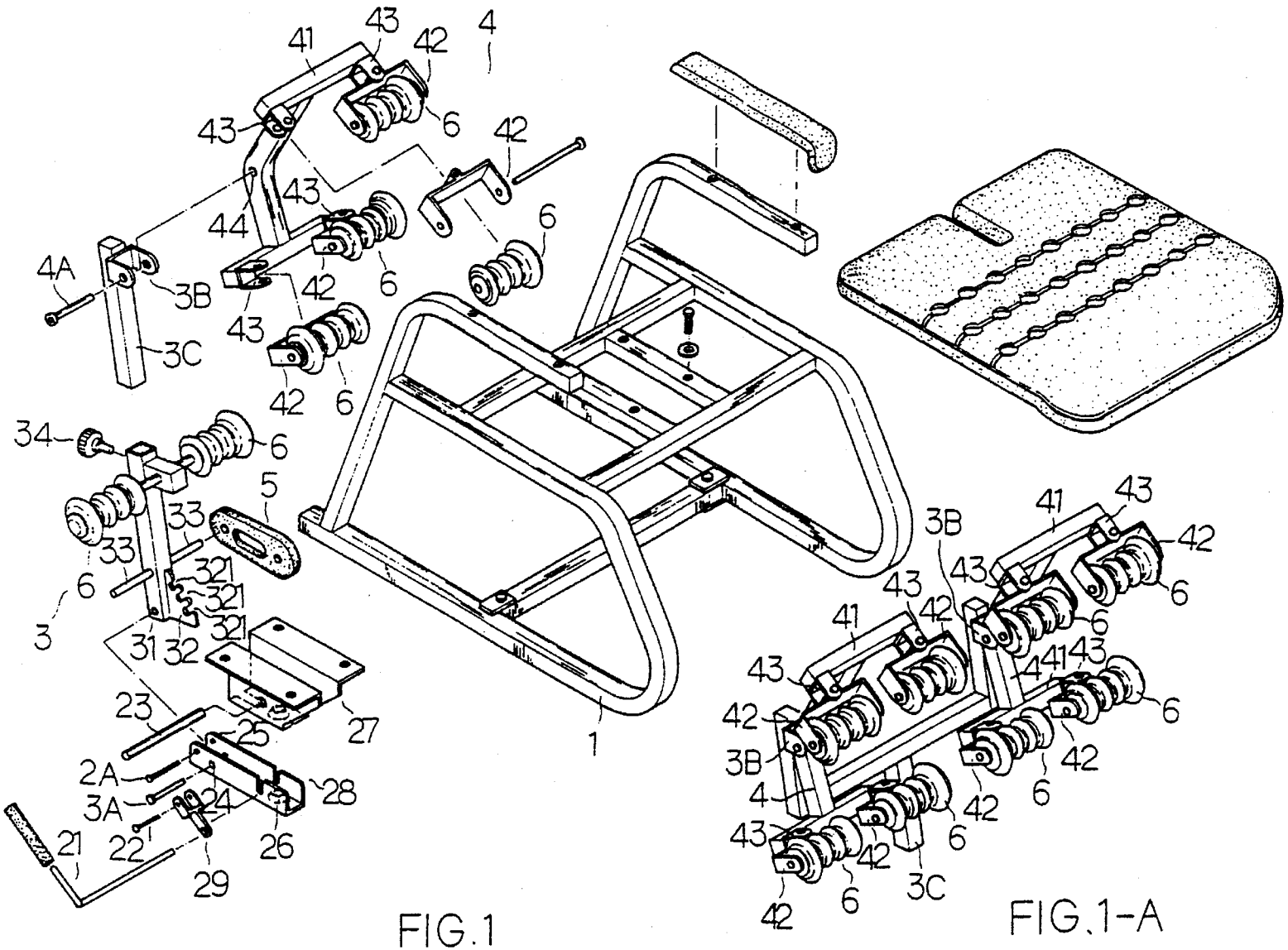
FIG. 1 is an exploded view of a massaging chair according to the preferred embodiment of the present invention.
Figure 2:
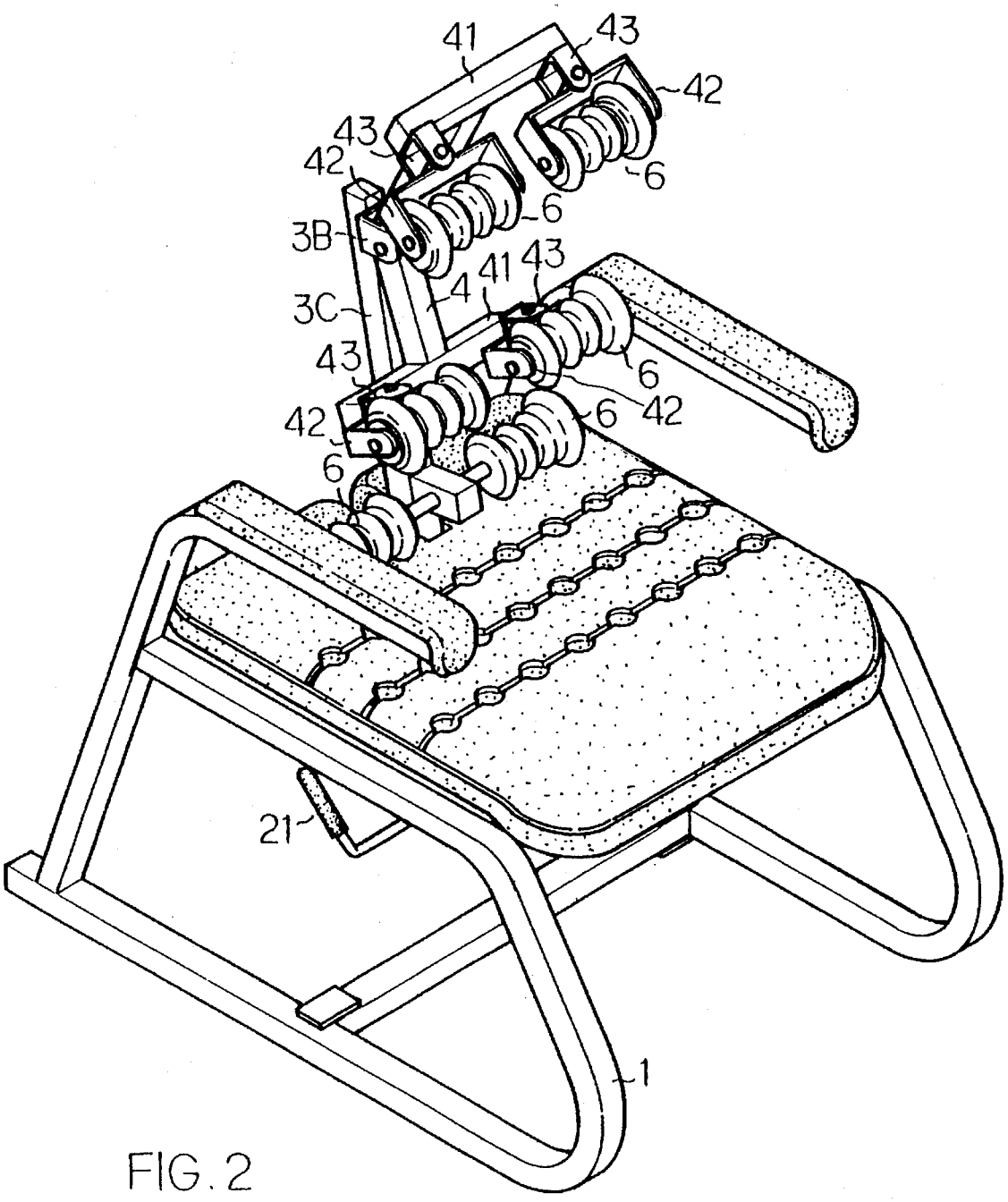
FIG. 2 is an elevational view of the massaging chair shown in FIG. 1.
Figure 3:
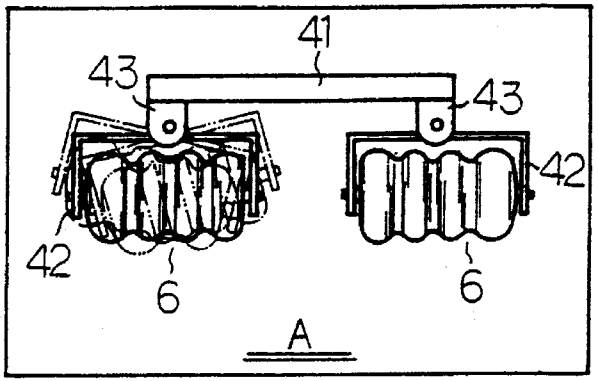
FIG. 3 is a side view of the massaging chair shown in FIG. 2.
Figure 3:
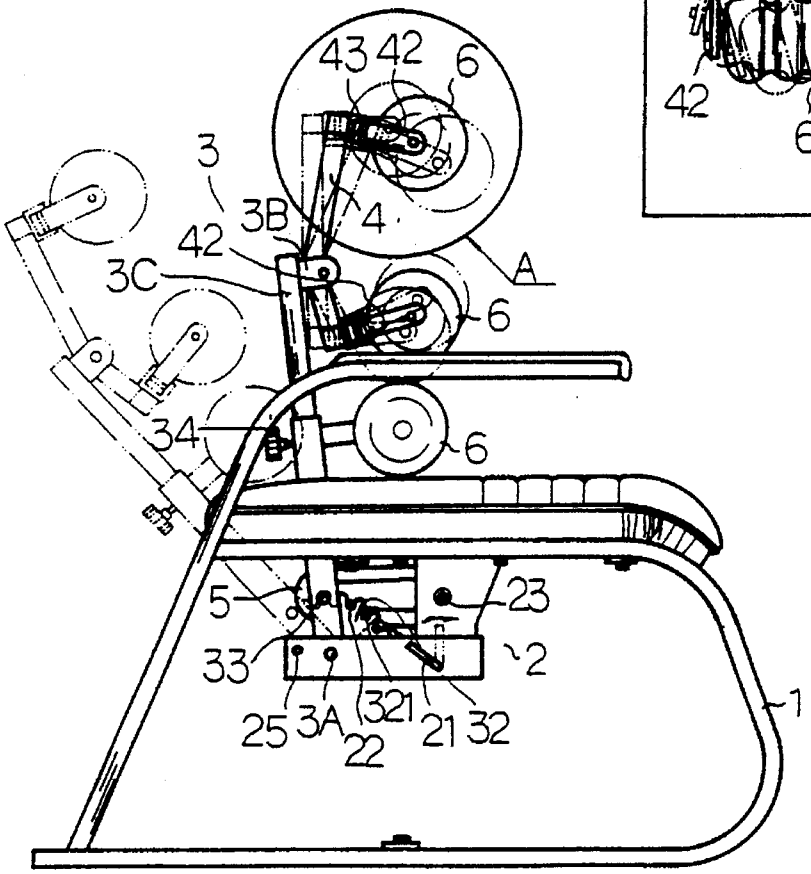
Figure 4:
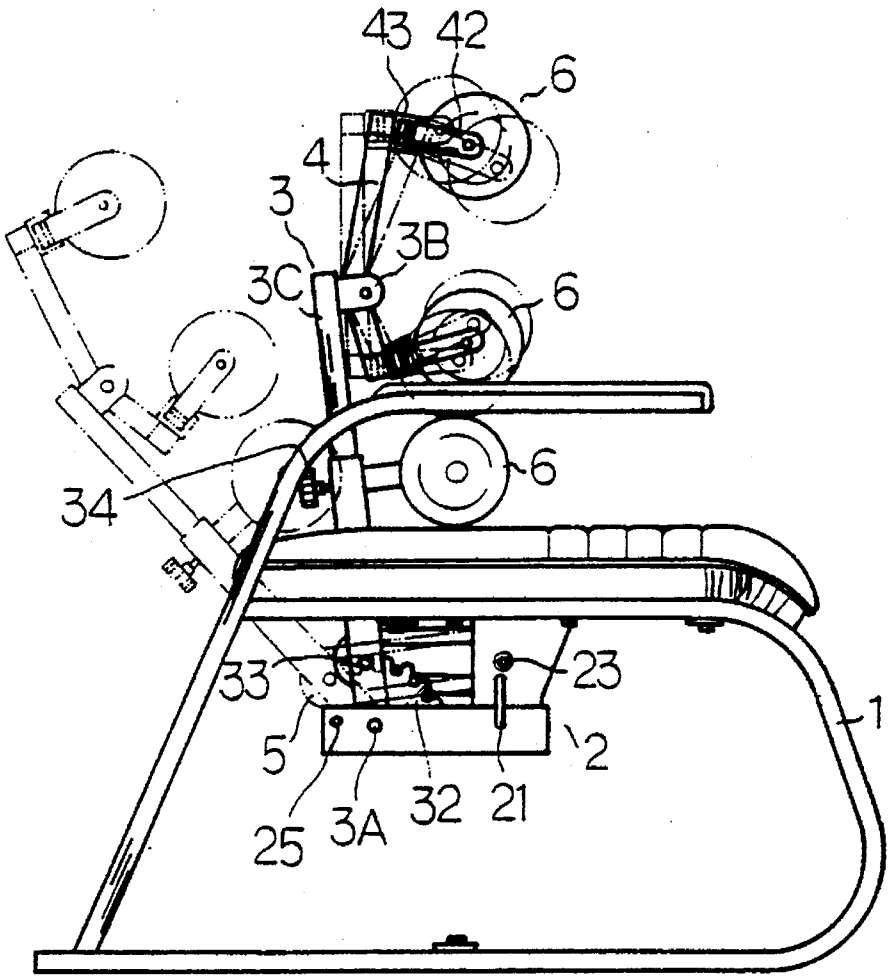
FIG. 4 is similar to FIG. 3 but showing the back support turned about the pivot on the horizontal mounting frame to stretch the elastic members.

Referring to FIGS. 1 and 2, a massaging chair in accordance with the present invention is generally comprised of a base frame 1, an adjusting mechanism 2, a back support 3, a back rest 4, and at least one elastic member 5.

Referring to FIGS. 1, 3, 3A, and 4, the adjusting mechanism 2 comprises a vertical mounting frame 27 welded to the base frame 1 on the inside at a suitable location to hold a cross rod 23. A horizontal mounting frame 28 has its front end welded to the vertical mounting frame 27 at the bottom, and a through hole 26 is provided near the front end thereof. A transverse stop rod 2A is fastened between holes 25 on the horizontal mounting frame 28. A crank lever 21 is coupled to the horizontal mounting frame 28, and a transverse pivot 3A is fastened between holes 24 on the horizontal mounting frame 28. The transverse pivot 3A is disposed between the crank lever 21 and the transverse stop rod 2A. A forked member 29 is welded to the crank lever 21 to hold a transverse locating rod 22. When the crank lever 21 is turned, the forked member 29 is moved to turn the transverse locating rod 22 forward or backward.

The back support 3 is made of a square tube having a pivot hole 31 near the bottom end thereof turned about the pivot 3A. A sector plate 32 is provided near the bottom end of back support 3. This sector plate 32 has a series of retaining notches 321 on the arc thereof. A cross rod 33 is provided in the middle of the square tube of the back support 3. This cross rod 33 is linked to the cross rod 23 on the vertical mounting frame 27 by at least one elastic member 5. Preferably, two elastic members 5 are bilaterally connected between the cross rods 23 and 33. Massaging wheels 6 may be installed in the back support 3 at a suitable elevation. The back support 3 further includes a retractable supporting bar 3C at the top controlled by a lock screw 34 (see also FIG. 2). By means of loosening the lock screw 34, the position of the retractable supporting bar 3C on the back support 3 can be adjusted vertically. The retractable supporting bar 3C comprises a pivot holder 3B to hold a pivot 4A.

The back rest 4 includes a pivot hole 44 in the middle turned about the pivot 4A on the retractable supporting bar 3C. Two transverse bars 41 are horizontally disposed at two opposite ends of the back rest 4 (see also FIGS. 1-A and 2). A plurality of mounting lugs 43 respectively are fastened to the transverse bars 41, and a plurality of brackets 42 are mounted on the lugs 43. The brackets 42 may be horizontally turned about a respective pivot (see FIG. 3-A) on the mounting lugs 43. The brackets 42 are provided to hold a respective massaging wheel 6. By engaging the transverse locating rod 22 of the forked member 29 into any of the retaining notches 321 on the sector plate 32 of the back support 3, the back support 3 is retained in a desired sloping position on the base frame 1. By turning the crank lever 21, the transverse locating rod 22 can be moved from one retaining notch 321 on the sector plate 32 to another, and therefore the sloping position of the back support 3 is changed. By disconnecting the transverse locating rod 22 from the sector plate 32, the back support 3 can be turned backward to stretch the elastic members 5. However, the backward movement of the back support 3 is limited by the stop rod 2A in hole 25 (See FIG. 4). When the position of the back support 3 is set, the back rest 4 can be vertically turned about the pivot 4A on the pivot holder 3B (see FIG. 3), and the brackets 42 can be respectively turned about the respective pivots horizontally (see FIG. 3A). Therefore, when one sits on the chair and has one's back moved on the back rest 4, the back is massaged by the massaging wheels 6.

Figure 5:
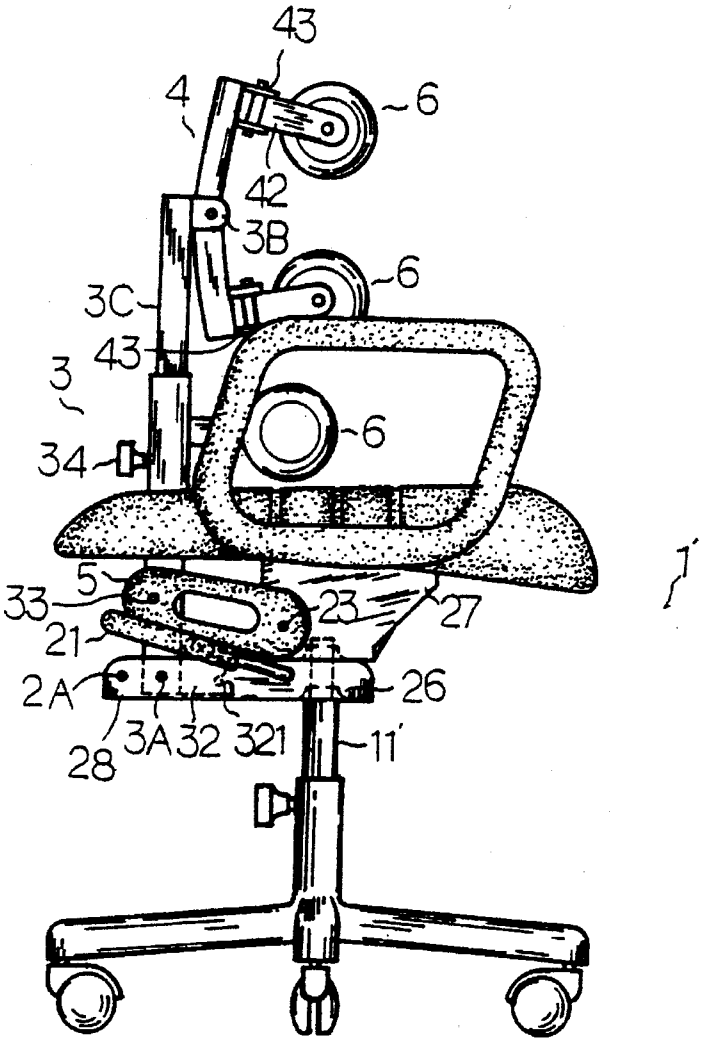
FIG. 5 shows the massaging chair of FIG. 2 supported on a wheeled support.

Referring to FIG. 5, the base frame 1 may be supported on a wheeled support 1'. The wheeled support 1' comprises a threaded stem 11' threaded into the through hole 26 on the horizontal mounting frame 28, and therefore the massaging chair is supported on the wheeled support 1'.

While only one embodiment of the present invention has been shown and described, it will be understood that various modifications and changes could be made without departing from the spirit and scope of the invention. For example, spring means, hydraulic or pneumatic reciprocating means may be installed to replace the elastic members 5.

What is claimed is:

1. A massaging chair, comprising:

a base frame to hold a seat for sitting;

a mounting frame fastened to said base frame beneath said seat, said mounting frame including a pivot near a front end thereof and a cross rod near a rear end thereof;

a back support having a bottom end pivoted about the pivot on said mounting frame and a top end, said back support including a sector plate near the bottom end thereof, the sector plate having a series of retaining notches, the back support further including a cross rod in a middle portion thereof, and a plurality of rotating massaging wheels horizontally mounted thereon near the top end thereof;

lock means controlled to lock said back support in position, said lock means including a crank lever, a forked member welded to said crank lever, a locating rod transversely fastened to said forked member and movable to engage into one of the retaining notches on said sector plate of said back support;

linking means connected between the cross rod on said back support and the cross rod on said mounting frame, said linking means being able to return to a former shape after being pulled;

a retractable supporting bar fastened to said back support at the top end thereof and locked in position by a lock screw, said retractable supporting bar including a top, wherein a pivot is provided at the top; and a back rest including a pivot hole defined in a middle portion thereof, said back rest pivoted about the pivot on said retractable supporting bar, two transverse bars horizontally disposed at two opposite ends of the back rest, a plurality of mounting lugs respectively fastened to the transverse bars of said back rest, and a plurality of brackets turnable about a respective pivot on each mounting lug, each of said brackets provided to hold a respective rotating massaging wheel; and wherein said back support can be released from said lock means and turned about the pivot on said mounting frame to stretch said linking means.

2. The massaging chair of claim 1 wherein said back rest is turnable about the pivot on said retractable supporting bar in the vertical direction; and each bracket of the back rest is respectively turnable about the respective pivot in the horizontal direction.

3. The massaging chair of claim 1 further comprising a wheeled support fastened to said mounting frame to make the massaging chair easy to move.

4. The massaging chair of claim 1 wherein said linking means is made of rubber.

5. The massaging chair of claim 1 wherein said linking means is an elastic member.

6. A massaging chair, comprising:

a base frame for holding a seat;

a mounting frame fastened to the base frame beneath the seat, the mounting frame including a pivot proximate a first end thereof and a cross rod proximate a second end thereof;

a back support having a top end and a bottom end, wherein the bottom end is pivotally mounted to the pivot of the mounting frame, said back support including a sector plate proximate the bottom end thereof, the sector plate having a retaining notch, the back support further including a cross rod in a middle portion thereof;

lock means for locking the back support at a predetermined position, the lock means including a crank lever, a forked member connected to the crank lever, a locating rod fastened to the forked member and movable to engage into the retaining notch of the sector plate of the back support;

linking means connected between the cross rod of the back support and the cross rod of the mounting frame, the linking means being able to return to an original position after being pulled;

a retractable supporting bar fastened to the back support at the top end thereof and lockable into position by a lock screw, the retractable supporting bar including a top portion wherein a pivot is provided at the top portion; and a back rest including a pivot hole defined in a middle portion thereof, wherein the back rest is pivotally mounted about the pivot of the retractable supporting bar, wherein two transverse bars are disposed proximate two opposite ends of the back rest, wherein each transverse bar includes a mounting lug fastened thereto, and a bracket is pivotally mounted about a pivot of the mounting lug, wherein the bracket holds a rotatable massaging wheel; and wherein the back support is releasable from the lock means and movable about the pivot of the mounting frame to stretch the linking means.

7. The massaging chair of claim 6, further including a wheeled support fastened to the mounting frame.

8. The massaging chair of claim 6, wherein the linking means is made of rubber.

9. The massaging chair of claim 6, wherein the linking means is an elastic member.

10. The massaging chair of claim 9, wherein two elastic members are provided as the linking means.

* * * * *